US005259212A

United States Patent [19]

Engler

[11] Patent Number: 5,259,212

[45] Date of Patent: Nov. 9, 1993

[54] CRYOGENIC FREEZER WITH A LIQUID TRAP

[75] Inventor: Sidney V. Engler, Scarborough, Canada

[73] Assignee: Liquid Carbonic Corporation, Chicago, Ill.

[21] Appl. No.: 627,495

[22] Filed: Dec. 14, 1990

[51] Int. Cl.[5] ..... F25D 23/02; F25D 17/02

[52] U.S. Cl. ..... 62/266; 62/64; 62/65; 62/265; 62/374

[58] Field of Search ..... 62/265, 266, 64, 374; 34/242

[56] References Cited

U.S. PATENT DOCUMENTS

| | | | |
|---|---|---|---|
| 1,541,404 | 6/1925 | Smith | 34/242 X |
| 1,595,473 | 8/1926 | Minton | 34/242 |
| 1,944,857 | 1/1934 | Atwell | 62/265 X |
| 2,029,985 | 2/1936 | Clark et al. | 34/242 X |
| 2,059,970 | 11/1936 | Robillard | 62/104 |
| 2,582,789 | 1/1952 | Morrison | 62/265 X |
| 2,689,198 | 9/1954 | Judd | 34/242 X |
| 2,787,141 | 4/1957 | Julius | 62/169 |
| 3,090,134 | 5/1963 | Morrison | 34/242 |
| 3,096,627 | 7/1963 | Morrison | 34/242 X |
| 3,186,698 | 6/1965 | Thome | 34/242 X |
| 3,255,608 | 6/1966 | Macintosh | 62/266 X |
| 3,413,818 | 12/1968 | Pelmulder | 62/266 X |
| 3,415,083 | 12/1968 | Okazaki et al. | 34/242 X |
| 3,427,820 | 2/1969 | Hart | 62/307 |
| 3,482,412 | 12/1969 | Waldin | 62/266 X |
| 3,498,069 | 3/1970 | Waldin | 62/266 X |
| 3,733,839 | 5/1973 | Waldin | 62/266 X |
| 3,793,937 | 2/1974 | Lipoma | 62/374 X |
| 4,175,396 | 11/1979 | Miller et al. | 62/266 X |
| 4,783,972 | 11/1988 | Tyree et al. | 62/374 |
| 4,858,445 | 8/1989 | Rasovich | 62/374 |
| 4,878,362 | 11/1989 | Tyree | 62/381 |
| 4,928,492 | 5/1990 | Howard | 62/266 X |

FOREIGN PATENT DOCUMENTS

| | | | |
|---|---|---|---|
| 554507 | 1/1957 | Italy | 62/266 |

*Primary Examiner*—Henry A. Bennett
*Assistant Examiner*—Christopher B. Kilner
*Attorney, Agent, or Firm*—Lee, Mann, Smith, McWilliams, Sweeney & Ohlson

[57] ABSTRACT

A trap or seal system for effecting an air impervious seal for a food freezer, such as a cryogenic or mechanical freezer. The seal system includes a barrier forming a vapor-impervious partition and which has its bottom extending into a cryogenic bath. A conveyor system is used to transport articles through the cryogenic bath to a downstream cryogenic freezer. The combination of the barrier extending into the cryogenic bath forms an effective seal to prevent air infiltration into the cryogenic freezer.

10 Claims, 1 Drawing Sheet

SEAL
FREEZER
SEAL

FREEZER
SEAL 10
12
14
16
18
20
22
24
26
28
30
32
34
36
38
40
42
44
46
48
50
52

CRYOGENIC FREEZER WITH A LIQUID TRAP

BACKGROUND OF THE INVENTION

This invention relates to cryogenic freezers, and in particular to a trap or seal system for preventing undesired air infiltration into a freezer.

Cryogenic freezers for freezing of food products can be of many forms. For example, U.S. Pat. No. 4,783,972 illustrates a tunnel-type freezer while U.S. Pat. No. 4,878,362 illustrates a spiral-type freezer. In any type of freezer, for freezing purposes, a cryogen, such as liquid nitrogen or carbon dioxide, is employed for quick and effective freezing of food products.

A substantial and costly problem facing cryogenic freezers has always been infiltration of moisture-laden air. Air infiltration can also pose problems in mechanical type freezers. In the inventor's experience, cooling of the air and freezing of moisture from the air in a cryogenic freezer can account for consumption of the freezing cryogen of as much as 700 pounds per hour. As a result, freezer manufacturers have attempted to limit the infiltration of air into a cryogenic freezer by installing computer-controlled balancing of gas flow within the freezer, plastic flaps at the entrance, and other expensive and less than fully effective controls.

U.S. Pat. No. 2,059,970 discloses an immersion-type cryogenic freezer which attempts to trap and reuse gaseous cryogen which boils off the volatile refrigerating liquid used. While a raised trap is provided at the entrance and exit ends of the freezer, no positive seal is provided to prevent air infiltration.

U.S. Pat. No. 2,787,141 discloses an apparatus for precooling produce, the apparatus having a conveyor belt system which includes water seals at the entrance and exit ends. For an air seal at the entrance and exit, the conveyor belt dips beneath the legs of a U-shaped vacuum chamber. Produce is conveyed upwardly through a first leg of the U where it is conveyed to a cooling vacuum chamber, and then through the second leg of the U for downstream handling. The apparatus would not be satisfactory for freezing, however, since water is used as a seal, and freezing in a vacuum chamber is costly and ineffective.

SUMMARY OF THE INVENTION

The invention provides a seal system for effecting a complete gaseous seal for a freezer, such as a cryogenic or mechanical freezer. The system includes a sealed chamber having an entrance end and an exit end. A cryogenic bath is located in the chamber between the entrance and exit ends. A barrier forms a fluid-impervious partition in the chamber, and extends across the chamber and downwardly into the cryogenic bath. A passageway is immersed in the cryogenic bath at the barrier to permit passage of articles through the barrier, and means are provided for transporting articles from the entrance end, through the cryogenic bath and the passageway, and then to the exit end.

In accordance with the preferred form of the invention, the passageway comprises a gap beneath the barrier completely within the cryogenic bath so that no air can bypass the barrier as articles are conveyed through the cryogen beneath the barrier. The barrier comprises a metal wall or other suitable material, appropriately mounted within the chamber and sealing the chamber, and having its bottom immersed in the cryogenic bath.

The barrier divides the bath into two portions, a first portion into which articles are conveyed, and a second portion from which conveyed articles emerge. The barrier is located such that the first portion has a minimum surface area for the cryogenic bath, to eliminate as much as possible vapor boil off at this location.

In accordance with the preferred form of the invention, transporting of articles is by means of a conveyor belt. Between the entrance end and the cryogenic bath, the sealed chamber may be extended to include a pre-cool region. The pre-cool region may effectively use any boil off from the cryogenic bath to pre-cool articles before they are immersed in, and passed through, the bath.

In accordance with one form of the invention, the seal system is used as a seal for the entrance to a freezer. In accordance with another form of the invention, two seal systems according to the invention are employed with a freezer, one system forming a seal for the entrance to the freezer, and the other forming a seal for the exit from the freezer. In this latter form of the invention, because of pressure increases in a fully sealed freezer, a pressure relief valve is also employed to appropriately regulate pressure within the freezer.

BRIEF DESCRIPTION OF THE DRAWING

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figures 1, 2, 3:
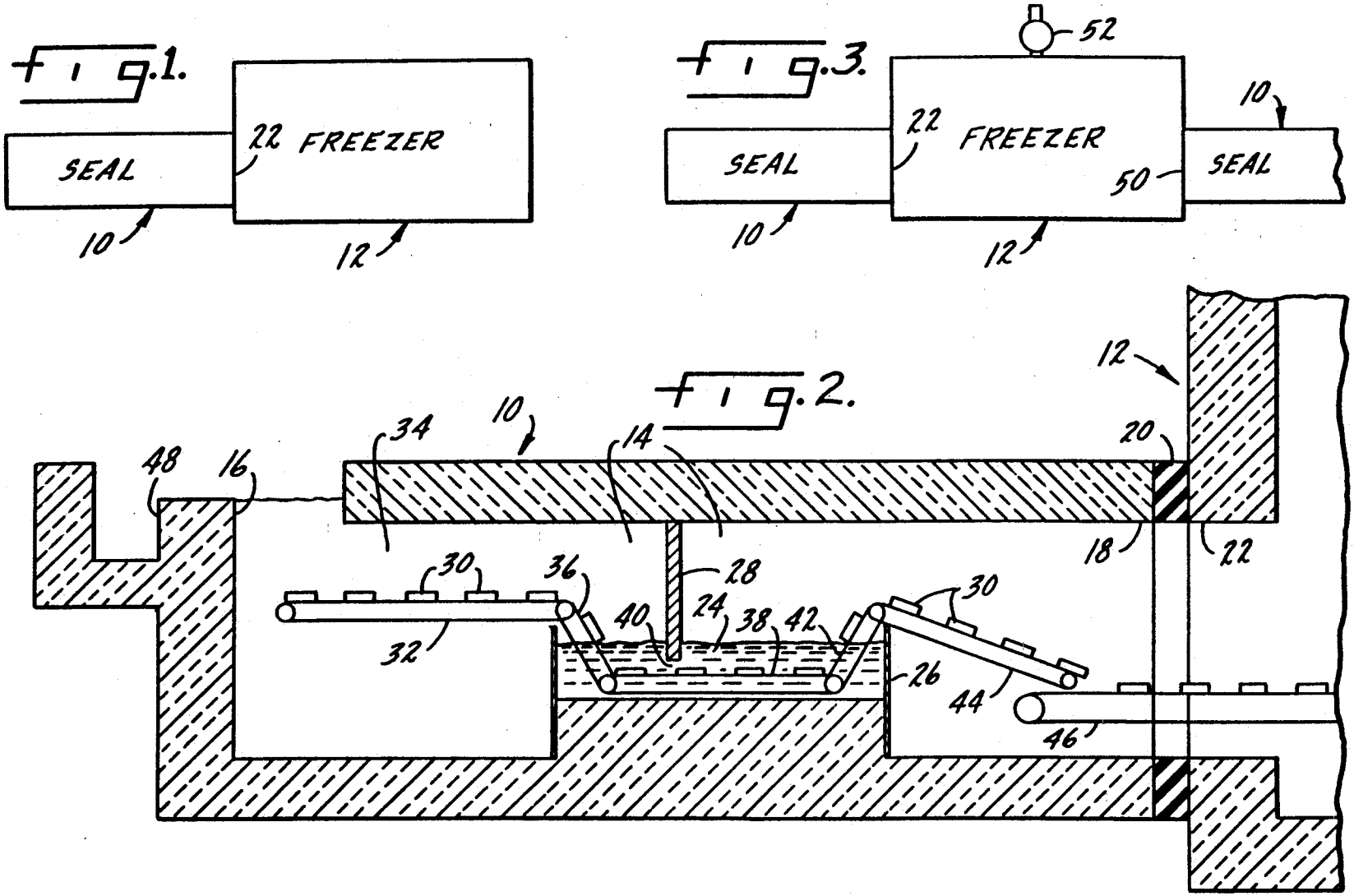
FIG. 1 is a schematic elevational view of a cryogenic freezer employing a seal according to the invention at the entrance to the freezer.
FIG. 2 is an enlarged elevational view, in cross section, showing in detail the seal system according to the invention, and illustrating only a small portion of the entrance to a cryogenic freezer, and FIG. 3 schematically illustrates a second form of the invention with a seal system according to the invention at both the entrance and exit ends of a cryogenic freezer.

A seal system according to the invention is shown generally at 10 in the drawing figures. The seal system 10 may be employed at the inlet or inlet and outlet of a cryogenic freezer 12, as described in further detail below. The freezer 12 may be conventional, such as a spiral-type or tunnel-type cryogenic freezer. Although a cryogenic freezer is described, it will be evident that the seal system 10 will also function with a mechanical-type freezer, or any other freezer experiencing air infiltration.

The seal system 10 is shown in detail in FIG. 2. Included in the seal system 10 is an internal chamber 14 which is sealed except for its entrance end 16 and its exit end 18. The walls of the seal system 10 are appropriately insulated as shown in section, to maintain the internal environment within the system 10 and downstream freezer 12 as consistent as possible. A seal 20 is employed at the junction of the exit end 18 of the seal system 10 with the inlet opening 22 of the cryogenic freezer 12 to avoid any air infiltration and excessive heat loss at that location.

A cryogenic bath 24 is located within the chamber 14, in an appropriate receptacle 26. A barrier 28, forming a vapor-impervious partition in the chamber 14, extends fully across the width of the chamber 14 from the top thereof, completely blocking any vapor flow through the chamber 14. As illustrated, the barrier 28 extends into the cryogenic bath 24 to complete an air impervious partition in the chamber 14. The cryogenic bath may contain any known cryogen, such as liquid nitrogen, and preferably a cryogen which is compatible with any cryogen which may be within the freezer 12. The cryogenic bath 24 is replenished as needed (the source of replenishment not illustrated) in order to maintain the level of the cryogenic bath 24 as illustrated, with the barrier 28 always extending into the cryogenic bath.

Transportation of food products through the seal system 10 is shown schematically in FIG. 2. Food products 30, such as fish fillets, hamburgers, fried chicken and other similar items to be frozen, are deposited through the entrance end 16 (means not illustrated) onto a first horizontal conveyor section 32 which leads through an entry segment 34 of the chamber 14 to a second, downwardly inclined conveyor section 36. The food products 30 continue down the second conveyor section 36 and enter the cryogenic bath 24 before continuing on a third conveyor section 38. The now-immersed food products 30 proceed on the conveyor section 38, through a passageway 40 beneath the barrier 28, and to a fourth conveyor section 42, where the food products 30 are withdrawn from the cryogenic bath 24. Thereafter, the food products 30 continue on a fifth conveyor section 44 leading to an entrance conveyor 46 passing through the inlet opening 22 into the cryogenic freezer 12.

The barrier 28 divides the cryogenic bath 24 into two portions, a first portion into which the conveyor section 36 transports the food products 30, and a second portion from which the conveyor section 42 removes food products from the cryogenic bath 24. Typically, the entrance 16 is opened to the atmosphere, and therefore some boil-off of the cryogenic bath 24 occurs from the first portion of the bath upstream of the barrier 28 as the food products 30 are conveyed by the conveyor section 36 into the bath. To minimize the boil off, the barrier 28 is located as close as reasonably possible to the conveyor section 36 so that as small a surface area of the cryogen as possible is provided upstream.

Since any cryogenic vapor boiling off the cryogenic bath 24 is still extremely cold, the vapors can be used in the extended entry segment 34 of the chamber 14 for pre-cooling the food products 30 as they enter the seal system 10. A length of the segment 34 on the order of 10 to 15 feet is sufficient to precool the food products 30 before their immersion in the cryogenic bath 24. The precooling segment 34 is desireable, but not required.

As liquid nitrogen boils from the cryogenic bath 24, the nitrogen vapor generated travels from right to left in the segment 34 (FIG. 2) to the entrance end 16, where the gaseous nitrogen is expelled. Quite often, the gaseous nitrogen is simply expelled to the atmosphere, but it can also be collected in an evacuation channel 48 just outside the entrance end 16. A small exhaust fan (not illustrated) can be used to draw spill over gaseous nitrogen from the entrance end 16 into the evacuation channel 48.

In the preferred form of the invention, the seal system 10 is aligned with the inlet opening 22 of the cryogenic freezer 12. This forms an essentially perfect, totally air impervious seal to the freezer 12. Minimal freezing of the food products 30 occurs in the seal system 10. As the products are frozen in the freezer 12, liquid cryogen in the freezer, which turns to its gaseous phase as heated by the freezing food products, can escape through the outlet opening of the freezer. Because the inlet opening 22 is sealed, the escape of gaseous cryogen can be closely controlled, and no air infiltration will occur.

FIG. 3 illustrates a form of the invention where one sealing system 10 is used to seal the inlet opening 22 of a freezer 12, while a second seal system 10 is used to seal the outlet opening 50 of the freezer 12. In this instance, since product being frozen within the freezer 12 causes liquid nitrogen or other liquid cryogen to vaporize, vapor pressure will build within the freezer 12. If vapor pressure is allowed to build unabated, sufficient pressure will build to eventually cause vapor to escape beneath one of the barriers 28, breaching the integrity of the seal formed by the barrier 28 in combination with the cryogenic bath 24. To avoid this result, the freezer 12 is provided with a pressure relief valve 52, adjustable if and as desired, to release excess vapor pressure within the freezer 12.

The seal system 10 according to the invention provides an effective, yet simple air impervious seal for the inlet or outlet from the freezer 12. While one form of the seal system 10 has been illustrated in the drawing figures, it will be evident that various changes can be made to the invention without departing from the spirit thereof or scope of the following claims.

What is claimed is:

1. A seal system of continuously effecting a gaseous seal for an opening into a freezer, comprising a. a sealed chamber having an entrance end and an exit end, one of said ends being connected to the freezer opening, b. a cryogenic bath located in said chamber between said entrance and exit ends, said bath being separate from any freezing medium in said freezer, c. a barrier forming a vapor-impervious partition in said chamber, said barrier extending into said cryogenic bath, d. a passageway immersed in said cryogenic bath at said barrier, and e. means for transporting articles from said entrance end, through said cryogenic bath and said passageway, and to said exit end.

2. A seal system according to claim 1 in which said passageway comprises a gap beneath said barrier.

3. A seal system according to claim 1 in which said barrier comprises a metal wall having bottom immersed in said cryogenic bath.

4. A seal system according to claim 1 in which said means for transporting comprises a belt conveyor.

5. A seal system according to claim 1 including a pre-cool region located between said entrance end and said cryogenic bath.

6. A seal system according to claim 5 in which said pre-cool region comprises a horizontally enlongated segment of said chamber.

7. In combination, a cryogenic freezer having a product inlet opening, and a seal system according to claim 1, said exit end being sealingly connected to said product inlet opening.

8. In combination, a cryogenic freezer having a product inlet opening and a product outlet opening, and a pair of seal systems according to claim 1, one said seal system being situated with its said exit end being connected to said product inlet opening and the other said seal system being located with its said entrance end being connected to said product outlet opening.

9. The combination according to claim 8 including means for regulating pressure within said freezer.

10. The combination according to claim 9 in which said regulating means comprises a pressure relief valve.

* * * * *